US011927407B2

(12) United States Patent
Kastrun et al.

(10) Patent No.: US 11,927,407 B2
(45) Date of Patent: Mar. 12, 2024

(54) SAFETY SELECTOR FOR A FIREARM

(71) Applicant: GLOCK TECHNOLOGY GMBH, Ferlach (AT)

(72) Inventors: Mario Kastrun, Maria Rain (AT); Patrick Nolte, Klagenfurt (AT); Karl Markut, Klagenfurt (AT)

(73) Assignee: GLOCK TECHNOLOGY GMBH, Ferlach (AT)

( * ) Notice: Subject to any disclaimer, the term of this patent is extended or adjusted under 35 U.S.C. 154(b) by 0 days.

(21) Appl. No.: 18/040,958

(22) PCT Filed: Dec. 14, 2021

(86) PCT No.: PCT/EP2021/085700

§ 371 (c)(1),
(2) Date: Feb. 7, 2023

(87) PCT Pub. No.: WO2022/148614

PCT Pub. Date: Jul. 14, 2022

(65) Prior Publication Data

US 2023/0288159 A1 Sep. 14, 2023

(30) Foreign Application Priority Data

Jan. 11, 2021 (EP) ..... 21150933

(51) Int. Cl.
*F41A 17/46* (2006.01)
*F41A 35/06* (2006.01)

(52) U.S. Cl.
CPC ..... *F41A 17/46* (2013.01); *F41A 35/06* (2013.01)

(58) Field of Classification Search
CPC ..... F41A 17/46; F41A 35/06; F41A 19/46
USPC ..... 89/128, 148
See application file for complete search history.

(56) References Cited

U.S. PATENT DOCUMENTS

| | | | | |
|---|---|---|---|---|
| 8,276,502 | B1 | 10/2012 | Wright | |
| 8,549,982 | B2 | 10/2013 | Troy, Jr. | |
| 9,557,128 | B2 | 1/2017 | Miller, III | |
| 9,587,897 | B1 | 3/2017 | Huang | |
| 10,126,081 | B1 * | 11/2018 | Geissele | F41A 19/46 |
| 10,724,813 | B1 | 7/2020 | Stanley | |
| 2017/0299304 | A1 | 10/2017 | Otte, Jr. | |
| 2020/0033088 | A1 | 1/2020 | Nguyen | |

FOREIGN PATENT DOCUMENTS

EP 3572761 B1 4/2021

* cited by examiner

*Primary Examiner* — Reginald S Tillman, Jr.
(74) *Attorney, Agent, or Firm* — Raven Patents, LLC; Anton E. Skaugset

(57) ABSTRACT

A safety selector for a firearm, including a first lever including an integrally formed safety shaft and a first handle located outside the lower receiver for actuation, as well as a bearing portion, a selector portion and a connecting portion. To facilitate disassembly and interchangeability, the first lever is configured for spring-biased coupling to a securing element and has, on the connecting portion, a positioning protrusion projecting toward the opposite side of the weapon. In a longitudinal direction, the positioning protrusion has a shape-complementary bore for receiving a connecting assembly which includes a connecting element, a spring and a spring lock.

17 Claims, 5 Drawing Sheets

Fig. 1
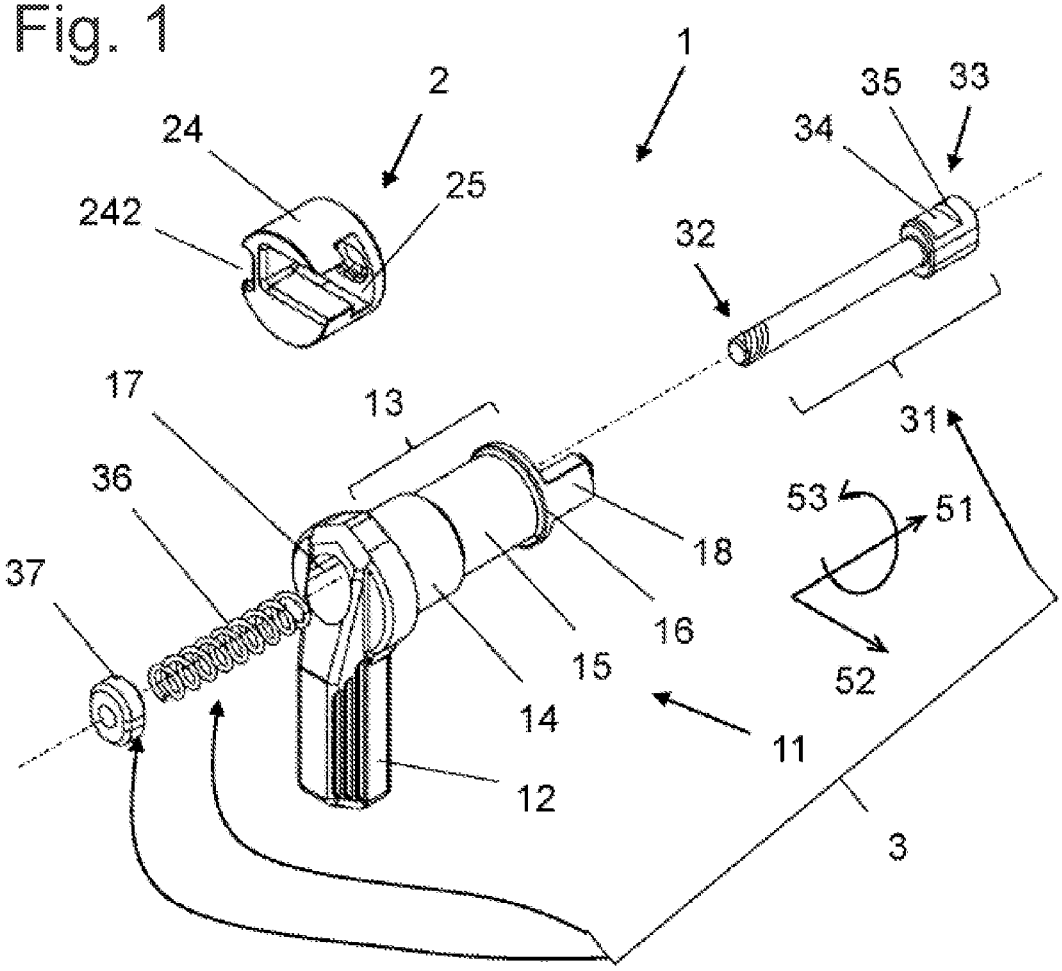
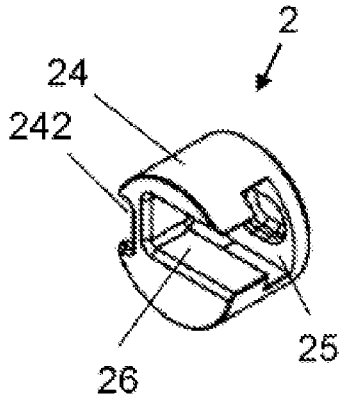
Fig. 2A
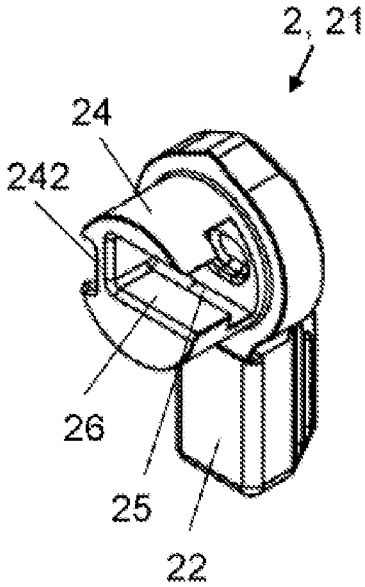
Fig. 2B
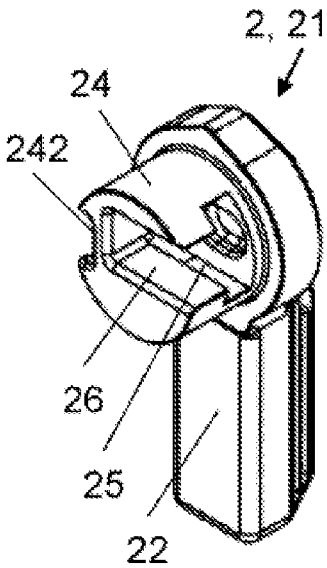
Fig. 2C

SAFETY SELECTOR FOR A FIREARM

TECHNICAL FIELD

The present disclosure is directed to firearms. More specifically, the present disclosure is directed to safety selectors for firearms, and in particular to safety selectors adapted for ambidextrous use for handheld firearms.

BACKGROUND

Many rifles, particularly those built on or compatible with the AR15 platform, have a safety selector located in the lower receiver. The safety selector is usually constructed as one piece when used on one side and in a plurality of pieces when used on both sides, and is mounted on the right and the left in the lower receiver. The safety selector can be brought into predefined rotational positions in the lower receiver, which positions correspond either to the securing of the trigger or to one or more firing selection positions. The safety selector is held in its respective rotational position by a selector pin which is spring-biased against the safety selector relative to the lower receiver.

Assembly is usually performed by dismantling the grip of the rifle and disengaging the selector pin from the opening for the safety selector. The safety selector can then be pushed laterally into the lower receiver and is fastened in the lower receiver by mounting the selector pin and/or the grip. However, this process is relatively time-consuming and not very user-friendly.

In recent years, the need for good operability of the rifle, individually tailored to the user, has also become established in many places. Associated with this requirement, the handle of the safety selector protruding from the lower receiver should be easily accessible or actuatable. It can thus be advantageous to the shooter if the safety selector can be actuated not only on the left side of the lower receiver, but rather or also simultaneously on the right side of the lower receiver.

In the past, some attempts have been made which allow the safety selector to be operated from both sides. Examples are U.S. Pat. Nos. 8,276,502 B1, 8,549,982 B2, 9,557,128 B2 and also U.S. Pat. No. 9,587,897 B1, the description of which is hereby incorporated by reference as part of this disclosure—in the jurisdictions in which this is possible.

Using the example of U.S. Pat. No. 9,557,128 B2, a reversibly usable safety selector is known in which two shoulders are attached to a safety shaft for mounting in the housing, each shoulder comprising a cam. However, it is necessary to dismantle the grip in order to be able to swap or turn the safety selector. In addition, securing with screws from the outside is relatively time-consuming and carries the risk that they can loosen during operation.

A series of multi-part safety selectors are thus known to a person skilled in the art, all of which require more or less difficult dismantling/assembly processes in order to allow simplified and/or ambidextrous operation.

In certain cases, however, it may be necessary to provide a safety selector that is operable on both sides, such as for weapon exercises, training, etc., which safety selector is intended to be readapted to the needs of the shooter after the exercise. In this specific case, this can also mean that the shooter might wish to refrain from right-sided operation of the safety selector after using an ambidextrous safety selector for exercise purposes. In addition, it may be desirable to be able to choose between a safety selector having a selector angle range of 90° between the "safe position" and a "firing position" and a second safety selector having a smaller selector angle range. With the known safety selectors, retrofitting is extremely time-consuming and, in some cases, not possible without an appropriate tool. This means that it may not even be possible to adapt the safety selector in the operational area.

What is needed, therefore, is a safety selector which is easy to manufacture and operate, and which allows disassembly/assembly without first having to remove the selector pin and/or the grip of the rifle.

SUMMARY

The safety selector according to the present disclosure comprises a first lever comprising an integrally formed safety shaft which is designed to be received in a lower receiver of the firearm and to be rotated into at least one firing selection position, the first lever having a first handle located outside the lower receiver for actuation. Starting from the first handle, seen in the direction of the opposite side of the weapon, the safety shaft has a first, substantially cylindrical bearing portion, a selector portion formed adjacent thereto, and a connecting portion adjacent thereto. In the region of the selector portion, the safety shaft has one or more shoulders which are referred to as selector surfaces for selecting a corresponding safety or firing position.

In some examples, the safety selector of the present disclosure includes a first lever, a securing element, and a connecting assembly, where the first lever includes a first handle and an integrally-formed safety shaft, and is configured for a spring-biased coupling to the securing element. The safety shaft is configured to be received in a lower receiver of the firearm and to be rotatable into at least one firing selection position, and includes a first, substantially cylindrical bearing portion joined to the first handle in a direction toward an opposite weapon side, a selector portion formed adjacent to the bearing portion and having at least one primary selector surface, and a connecting portion adjacent to the selector portion. The first handle is configured to be outside the lower receiver for actuation of the safety selector when the safety shaft is received in the lower receiver. The securing element includes a substantially cylindrical bearing protrusion for mounting in the lower receiver, the bearing protrusion having in a circumferential direction a primary cam configured to interact with a selector pin disposed in the lower receiver, where the primary cam also defines a mounting groove that is directed toward a weapon midplane. The connecting assembly includes a connecting element, a spring, and a spring lock; the connecting element being configured at a first end for coupling to the spring lock and configured at its opposite, second end for coupling to the securing element. The first lever has, on the connecting portion of the safety shaft, a positioning protrusion projecting in a direction toward the opposite weapon side, and, in a longitudinal direction, a bore of complementary shape for receiving the connecting assembly; and the bearing protrusion defines a coupling recess that opens outwardly in a radial direction and in the longitudinal direction and is configured to couple to the second end of the connecting element and the positioning protrusion.

The features, functions and advantages of the safety selectors discussed herein can be achieved independently in various embodiments of the present disclosure or may be combined in yet other embodiments, further details of which can be seen with reference to the following description and drawings below.

DETAILED DESCRIPTION OF THE DRAWINGS

FIG. 1 is a perspective exploded view of an illustrative safety selector comprising a lever which can be operated on one side, according to the present disclosure.

FIGS. 2A to 2C depict selected illustrative embodiments of securing elements with and without a second handle, according to the present disclosure.

Figure 3A:
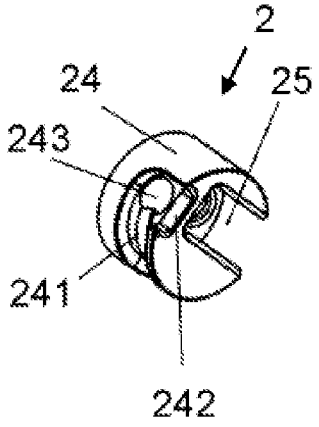
Figure 3B:
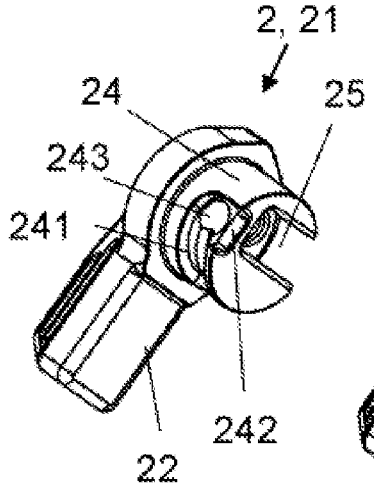
Figure 3C:
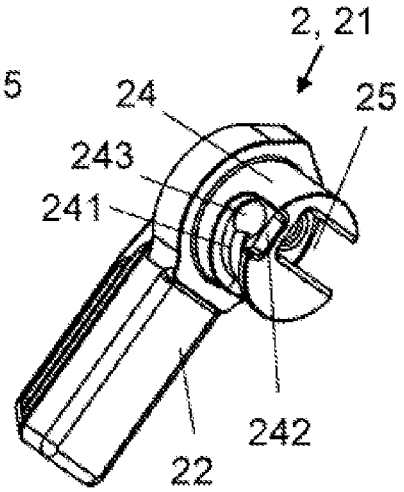

FIGS. 3A to 3C correspond to FIGS. 2A to 2C viewed from an alternative perspective.

Figure 4A:
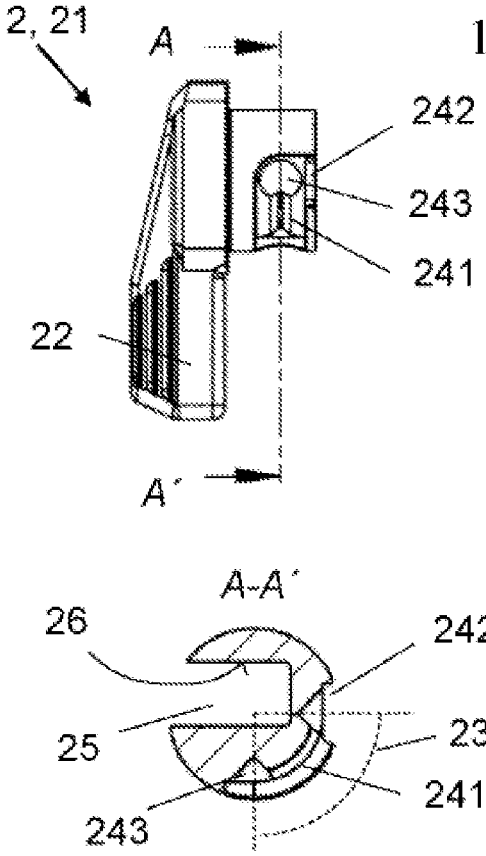
Figure 4B:
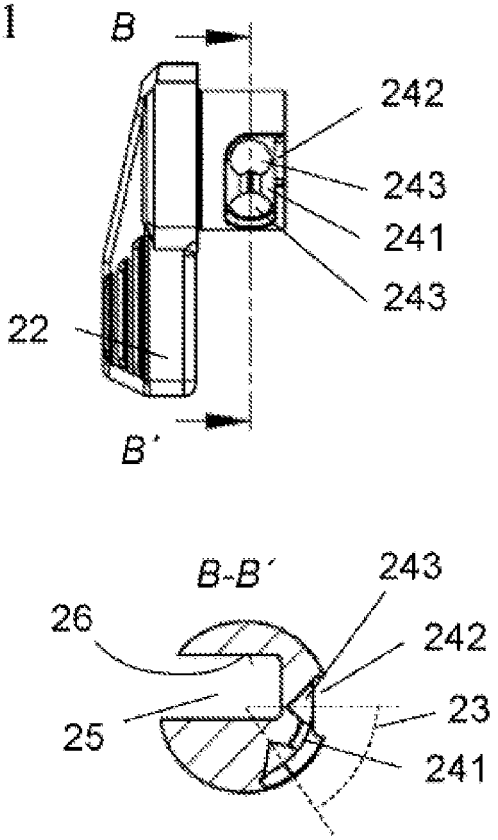

FIG. 4A depicts an illustrative second lever comprising a primary cam having a selector angle of approximately 90°; FIG. 4B depicts an illustrative second lever having a cam and a selector angle of less than 90°.

Figure 5A:
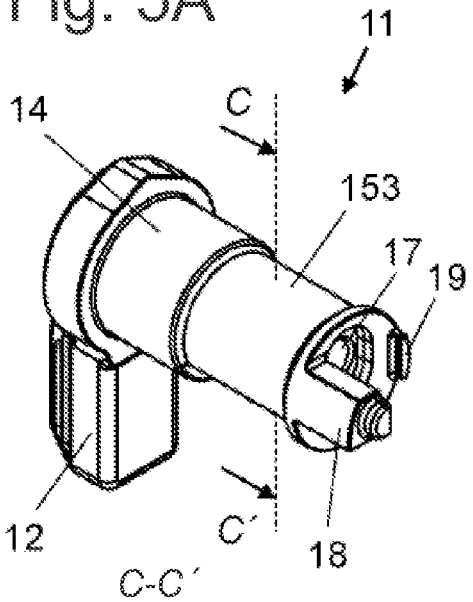
Figure 5B:
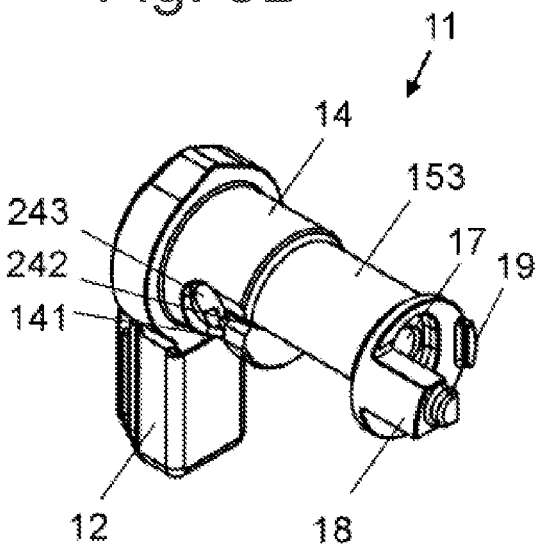

FIG. 5A depicts an illustrative a first lever; FIG. 5B depicts an illustrative first lever comprising a secondary cam.

Figure 6A:
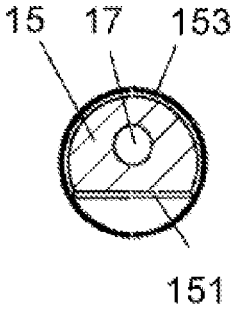
Figure 6B:
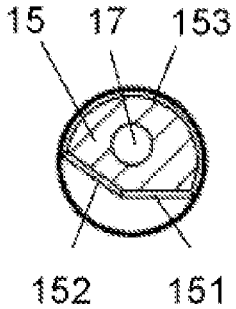
Figure 6C:
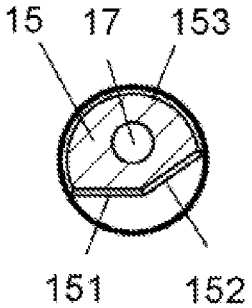

FIGS. 6A to 6C are sectional views of illustrative first levers according to the present disclosure having differently designed selector shafts, viewed along the sectional plane C-C' of FIG. 5A.

Figure 7:
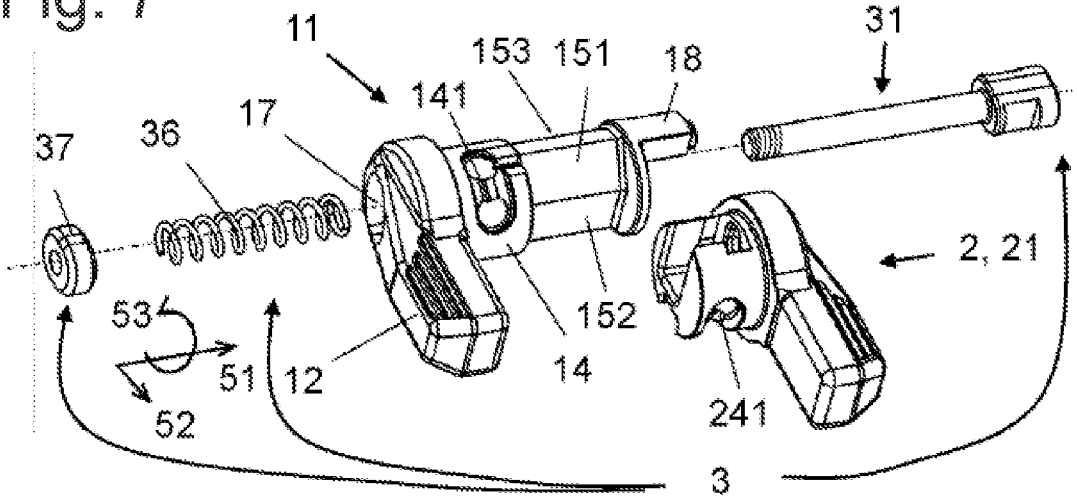

FIG. 7 is a perspective exploded view of an illustrative safety selector according to the present disclosure having two levers, and that can be operated on either side of the firearm.

Figure 8A:
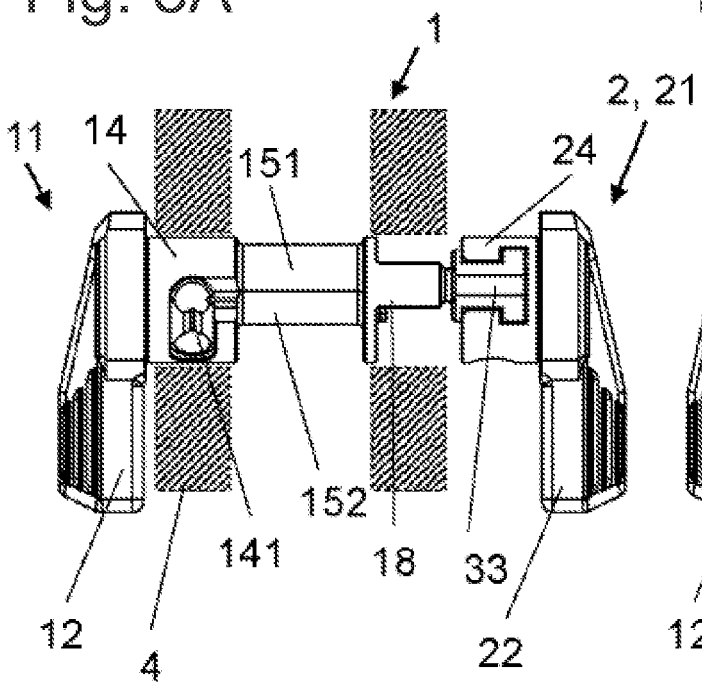
Figure 8B:
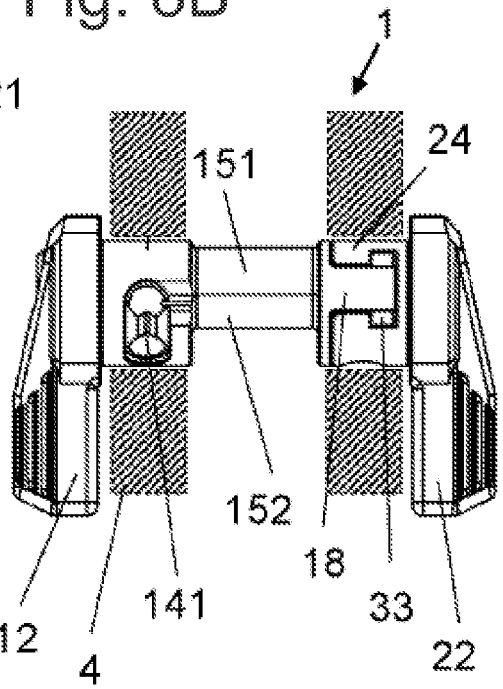

FIGS. 8A and 8B are top views of an installed illustrative safety selector according to the present disclosure, where the safety selector can be operated on either side of the firearm, with a deflected connecting element (FIG. 8A) and in a locked position (FIG. 8B).

Figure 9A:
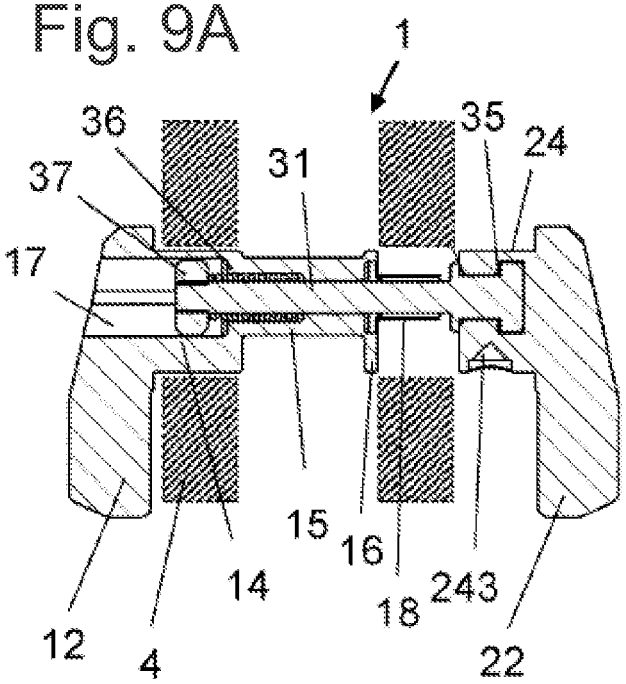
Figure 9B:
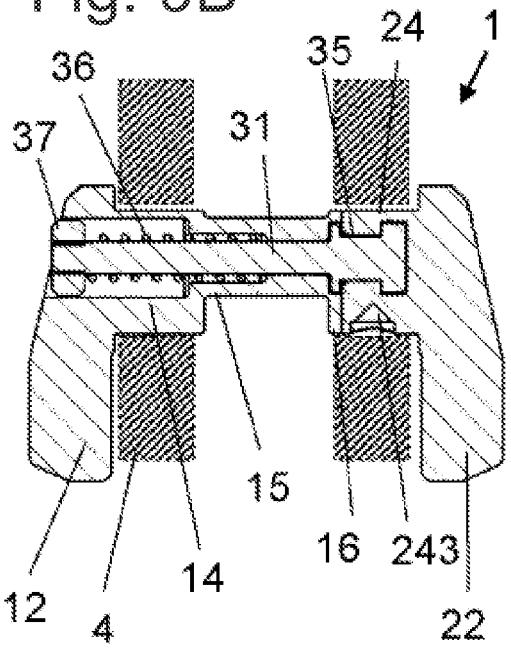

FIGS. 9A and 9B are sectional views corresponding to FIGS. 8A and 8B, respectively.

Figure 10A:
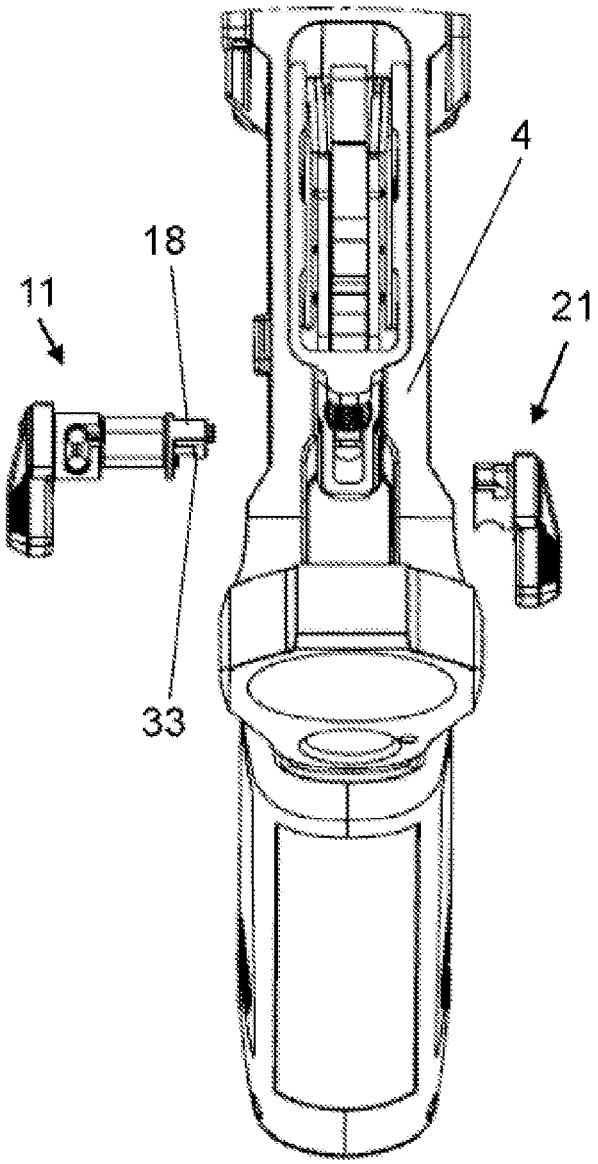
Figure 10B:
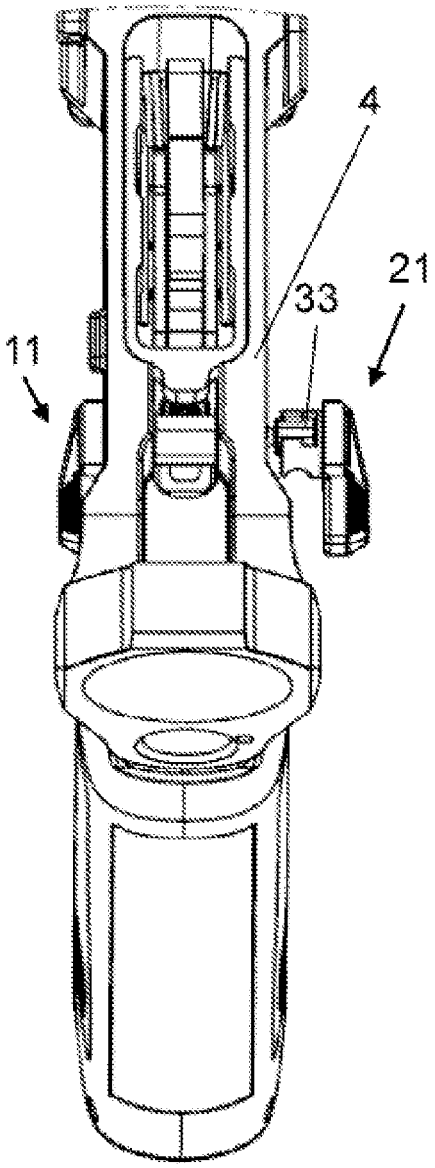

FIGS. 10A and 10B are top views of an installed safety selector according to the present disclosure, where the safety selector can be operated on either side of the firearm, before the coupling process (FIG. 10A) and in the coupled position (FIG. 10B).

DETAILED DESCRIPTION

The present disclosure relates to safety selectors that can be adapted for ambidextrous use for handheld firearms, in particular for firearms of the M4/M16/AR15 rifle type. The presently disclosed safety selectors are easy to manufacture and operate, and permit disassembly and/or assembly without first having to remove the selector pin and/or the grip of the rifle. In some examples, the safety selectors enable one-sided or ambidextrous operation, without tools, and requiring the smallest possible number of components. In some examples, the safety selectors can be implemented in an existing AR-15 receiver with the smallest possible effort. In some examples, the safety selectors offer the easiest possible adaptation of the selector angle to the needs of the shooter. The safety selectors of the present disclosure are not limited to rifles, carbines, etc., but can in principle also be used for pistols. Some embodiments and their effects/advantages are discussed below in greater detail.

The advantageous properties of the disclosed safety selectors are achieved by one or more of the features disclosed below. In one example, the first lever has a bore in its longitudinal or bore direction, which bore is designed to be complementary to the function and shape of a connecting assembly. The connecting assembly comprises a connecting element, a spring and a spring lock and is designed to couple a securing element and/or a second lever formed integrally therewith in a spring-biased manner. On the connecting portion of the first lever, seen in the direction of the opposite side of the weapon, a positioning protrusion is formed in the longitudinal direction. The connecting element is complementary in shape at its first end for coupling to the spring lock and at its opposite, second end for coupling to the securing element. The securing element has a substantially cylindrical bearing protrusion for mounting in the lower receiver or, in one limiting case, can also consist only of the bearing protrusion, or in another limiting case it can comprise a handle and thus be designed as a second safety selector. On the bearing protrusion, a primary cam is formed in the circumferential direction for interaction with a selector pin arranged in the lower receiver, which cam has a mounting groove directed toward the weapon midplane. In addition, for receiving and supporting the second end of the connecting element and/or the positioning protrusion, the bearing protrusion has a coupling recess which is open both outwardly in the radial direction as well as outwardly in the longitudinal direction.

The advantage of such a safety selector is the high degree of user-friendliness, since it is not necessary to dismantle/assemble the grip for installing or removing the safety selector. The interaction of the connecting assembly and the securing element and the cam arranged thereon allow the first lever to be inserted into the lower receiver from the left and, by actuating the connecting element, the second end of which is simply deflected over the contour of the right-hand side of the lower receiver, to be plugged to the securing element there. Subsequently, the spring of the connecting assembly ensures that the securing element is pulled in the direction of the weapon midplane. By means of the opening in the cam in the form of the mounting groove, it is possible to reach the installation position without having to remove the selector pin and/or the grip. In addition, in the installed situation, due to the existing spring-biased coupling of the first lever with the securing element, only a rotation of the safety selector in the circumferential direction is possible. In this way, the safety selector is positioned in the lower receiver and the risk of loss is significantly reduced.

Numerous further embodiments that are sometimes preferred are explained below with reference to the description of the figures. In particular, various possibilities are considered in this regard for achieving easier handling by means of bolt protrusions and/or the shape of individual components. In addition, the possibility of retrofitting the safety selector to ambidextrous operation is considered in particular, and individual adaptation proposals are made for optimizing the operation, such as setting the selector angle between the "safe position" and at least one "firing position."

Throughout the description and the claims, "in front of" or "forward(ly)" is used as the direction toward the muzzle of the barrel, "backward(ly)" is used as the direction toward the stock, "downward(ly)" is used as the direction for the bolt toward the magazine—that is, substantially downward in the vertical direction—and "upward(ly)" is used as the direction away from the magazine—that is, upward in the vertical direction. The terms "weapon midplane," "barrel core," "barrel axis," "core axis," etc. have the usual meaning assigned thereto in the prior art by a person skilled in the art. "Left" is thus related to the weapon midplane, "from the left" corresponds to a movement, actuation, or exertion of force in the direction of the weapon midplane, proceeding from a starting position "to the left" thereof, etc. Accordingly, the bolt or the bolt carrier is moved "backward" under the effect of the gases after a shot is fired and is moved "forward" again under the action of a recoil spring, etc.

In the context of the present disclosure, a safety selector 1 is disclosed, shown and described which is suitable for arrangement in a firearm, preferably an AR-15 type rifle, and designated with reference sign 1.

In the figures of the drawings, it has been attempted to designate everything that relates to the first lever 11 as "1 n", similarly using "2n" for the securing element 2 or the second lever 21 according to the present disclosure, "3n" for the connecting assembly 3, "4" for the lower receiver, and "5n" for the coordinate system fixed in relation to the safety selector 1 for orientation.

In FIG. 1, in the schematic exploded view, a safety selector 1 is shown comprising a first lever 11, a securing element 2, and a connecting assembly 3. The first lever 11 has a handle 12 which is situated outside the lower receiver 4 in the installed situation (see FIG. 10). The lever 11 has a safety shaft 13 which is formed in one piece with the handle 12 and, starting therefrom, in the longitudinal direction 51, i.e. in the direction toward the opposite weapon side (normal to the weapon midplane) in the installed situation, has a bearing portion 14 and, adjacent thereto, a selector portion 15. A relatively short connecting portion 16 is also arranged adjacent to the selector portion 15, from which connecting portion 16 a positioning protrusion 18 protrudes in the longitudinal direction 51. The connecting portion 16 is preferably designed to be substantially annular and has the same (external) diameter as the bearing portion 14. In this way, good guidance is ensured during insertion of the first lever 11 into the lower receiver 4 and the safety selector 1 can be supported well in the installed situation.

FIG. 1 clearly shows the connecting assembly 3 which is provided for coupling to the securing element 2 and which has at least one connecting element 31, a spring 36 and a spring lock 37. A first end 32 for coupling to the spring lock 37, or a second end 33 for coupling to the securing element 2, is formed on the connecting element 31. For this purpose, the securing element 2 has a coupling recess 25 which is designed to be complementary in shape and/or function to the second end 33. It can already be clearly seen from this illustration, especially when viewed together with FIGS. 9A to 10B, that in the installed situation the connecting element 31 can be arranged in a bore 17 in the first lever 11 that is axial or parallel thereto (FIG. 7) so as to be displaceable in the longitudinal direction 51 relative to the first lever 11. The bore 17 is designed to be complementary in shape to the components of the connecting assembly 3. The bore 17 is preferably configured as a stepped bore. The (inner) diameters of the respective steps substantially correspond to the diameters of the connecting element 31, the spring 36 and the spring lock 37, as can be clearly seen when viewed together with FIGS. 9A and 9B. However, a shoulder in the bore 17 would suffice as a one-sided abutment for the spring 36 to ensure the function of the safety selector 1.

In FIGS. 2A-2C different embodiments for a securing element 2 are shown schematically, for which the coordinate system from FIG. 1 can also be used. What they all have in common is that the securing element 2 has a bearing protrusion 24 which is used for mounting in the lower receiver 4. This bearing protrusion 24 preferably has the same diameter as the bearing portion 14 of the first lever 11. In addition, all the embodiments have a coupling recess 25 which is open in the longitudinal direction 51 and on at least one side in the radial direction 52. In this way, the second end 33 of the connecting element 31 can be pushed in laterally, i.e. in the radial direction 52, provided that it has been deflected far enough out of the first lever 11, as will be described later (see also FIG. 9). The simplest variant of the securing element 2 is shown in FIG. 2A, according to which the securing element 2 consists only of the bearing protrusion 24. In this form, the securing element 2 forms a type of (rotatable) "blind plug" on the right-hand side of the lower receiver 4 in the installed situation. This creates a unitary assembly that can be operated from one side. In one embodiment, the securing element 2 can have a projection or also a flange-like shoulder that abuts the outside of the lower receiver 4. In FIG. 2B and FIG. 2C, embodiments are shown which have a second handle 22 that is formed on the securing element 2. In this way, a second lever 21 is formed, by means of which the safety selector 1 can be operated on both sides of the lower receiver 4.

The different lengths of the second handles 22 in FIGS. 2B and 2C are intended to represent that the disclosed safety selector can have a plurality of shapes, lengths, surface structures, colors, etc. of the first lever 11 and/or second lever 21, or of the singular securing element 2, which can be freely combined with one another. The possible embodiments and combinations will not be discussed in detail since, with knowledge of the disclosure, it is at the discretion of a skilled person to adapt the the teachings of the disclosure optimally to the needs of the shooter.

Considering FIG. 1 and FIGS. 2A to 2C together, a preferred embodiment can also be recognized, according to which the second end 33 of the connecting element 31 has at least one bolt protrusion 35, which is formed projecting normally to the longitudinal direction 51, for coupling to the coupling recess 25 of the securing element 2. Even a rounded second end 33 of the connecting element 31 would suffice for coupling to the securing element 2. It has been found to be advantageous, however, if one or particularly preferably two diametrically opposite bolt protrusions 35, as can be clearly seen in FIG. 1, FIG. 3, FIG. 8 and FIG. 9, are formed on the second end 33. In this way, the orientation of the bolt protrusion(s) 35 can fulfill an additional function that represents a type of anti-twist protection and reduces the risk of loosening of the coupling during use, for example due to vibrations.

In a further preferred variant of the safety selectors of the disclosure, the second end 33 of the connecting element 31 and/or the spring lock 37 has a non-circular, elliptical, oval or polygonal, preferably rectangular, shape. The decisive factor herein is that a round head of the second end 33, as noted above, would already accomplish the coupling to the securing element 2, but the risk of the connecting element 31 rotating in the circumferential direction 53 can be significantly reduced by the choice of the shape of the second end 33. An independent or additional measure can be that the spring lock 37 has a non-round shape. As can be clearly seen in FIGS. 1 and 7, the spring lock 37 has an elliptical (or two semicircles with a straight connection) shape, which prevents the first lever 11 from rotating in the bore 17, which bore 17 has a complementary shape. Similarly, multi-sided polygonal shapes or even a triangular shape fulfill the same function of anti-twist prevention.

A particular aspect of the present disclosure relates to the arrangement and design of a primary cam 241 on the bearing protrusion 24 of the securing element 2. Because the spring-loaded selector pin—not shown, but well known to a person skilled in the art—protrudes obliquely from below in the lower receiver 4 (FIGS. 8, 9) into the transverse opening for receiving the safety selector 1, the separation according to the present disclosures of the first lever 11 and the securing element 2, or a second lever 21, in the manner described is very advantageous. Shown in each of FIGS. 3A to 3C are oblique views corresponding to the securing elements 2 shown in FIGS. 2A to 2C of second levers 21 in a different perspective. It can be clearly seen here that the primary cam 241 is formed in the circumferential direction 53 on the circumference of the bearing protrusion 24. The primary cam 241 is open in the longitudinal direction 51 (see FIG. 1), i.e. in the direction toward the opposite side of the weapon, in the installed situation. This opening can be designed as a V-shaped, U-shaped or rectangular recess and is referred to as a mounting groove 242. This has the effect described above that the first lever 11 can be inserted during the assembly of the device without being blocked by the selector pin. By means of the mounting groove 242, the securing element 2 can be pulled laterally into the lower receiver 4, which occurs in the correct position by means of the coupling to the connecting element 31, and the selector pin can engage in the primary cam 241. In this way, removal of the selector pin is prevented, as a result of which the user-friendliness and usability of the safety selector 1 according to the present disclosure is increased by comparison with known arrangements.

In addition, it can be clearly seen in all the embodiments in FIG. 3 that the primary cam 241 has two (radial) selector grooves 243 for defining the end position or limiting the movement of the selector pin and thus the rotation of the safety selector 1 in the circumferential direction 53. These act as a type of detent for the selector pin and are known to a person skilled in the art.

A further aspect of the present disclosure can also be clearly seen from FIGS. 1 to 5 and 7 to 10, according to which a positioning protrusion 18 is formed protruding in the longitudinal direction 51 on the connecting portion 16. This positioning protrusion 18 is used to transmit the torque or force of the first lever 11 and/or second lever 21 to the entire safety selector 1. It has been found to be advantageous to make the positioning protrusion 18 complementary to the coupling recess 25 in order to obtain a good contact surface and force transmission. Mutatis mutandis, it can be a preferred measure to form one (or more) catch surfaces 26 that are complementary in shape to the second end 33 of the connecting element 31 and/or the positioning protrusion 18 on the coupling recess 25 of the securing element 2. This relationship can also be seen clearly when viewed together with FIG. 2.

A further, possibly independent measure for optimizing the torque or force transmission when the first lever 11 and/or second lever 21 is actuated can consist in the second end 33 of the connecting element 31 having a flattened portion 34 that is complementary in shape to the catch surface 26. This embodiment is included in the selected drawings and is shown clearly in FIGS. 1, 7 and 9. This is particularly advantageous if the dimensions of the positioning protrusion 18 and the second end 33 are designed to be aligned in the radial direction 52, i.e. a form-fitting connection is formed which facilitates easy assembly of the safety selector 1.

For the clarity of the assembly of the safety selector 1, reference is made here to a joint consideration of the drawings, in particular FIGS. 1, 7, 8A and 8B, 9A and 9B, as well as 10A and 10B. First, although not shown in detail, the connecting element 31 is inserted into the bore 17 of the first lever 11, after which the spring 36 is inserted into the bore 17 and the first end 32 is coupled to the spring lock 37. The spring lock 37 can be designed, for example, as a type of plate and have one or more notches, the first end 32 having corresponding detent notches for coupling. Numerous possibilities for coupling the two elements, such as a latching or plug connection, and in particular the possibility of a screw connection (i.e. a threaded connection), are known to a person skilled in the art from the prior art. As can be particularly readily imagined from a joint consideration of FIGS. 7 and 9A, the coupling of the first end 32 to the spring lock 37 can be carried out by relatively simply screwing in the connecting element 31. If the connecting assembly 3, as can be seen in FIGS. 8A and 9A, or FIG. 10A, is brought into the disassembly/assembly position by means of pressure onto the side of the spring lock 37, the second end 33 of the connecting element 31 is deflected via the connecting portion 16 and also protrudes out of the lower receiver 4. The lower receiver 4 is indicated in FIGS. 8 and 9 as a shaded area. Thereafter, the securing element 2 or the second lever 21 can simply be pushed on and the safety selector 1 is pulled into the installed situation by the spring force of the spring 36 and held there during operation.

The possible embodiments described above make it possible, in a relatively simple manner, to provide a safety selector 1 which is very user-friendly to disassemble/assemble and also only requires a makeshift tool, such as a cartridge tip or a rod, to actuate the connecting element 31. In the installed situation, however, the spring lock 37 can terminate flush with the first lever 11 toward the outside, or can even be arranged set back behind the surface. This significantly minimizes the risk of accidental adjustment. In particular, the aforementioned individual measures or their combination can permanently ensure the position of the connecting assembly 3 in the operating state without the risk of the coupling to the securing element 2 autonomously releasing.

At this point it should be explicitly pointed out that the safety selector according to the present disclosure is also particularly suitable for optimizing the selector angle 23. This situation can be seen very well from FIG. 4, wherein in FIG. 4A an exemplary second lever 21 is shown comprising a cam 241 which assumes a selector angle of 90°. This can be clearly seen from the corresponding sectional view along the sectional plane A-A' in the lower half of the drawing. FIG. 4B shows a second lever 21 comprising a primary cam 241, the selector angle 23 of which is in an angular range of less than 90° (see sectional view B-B'). By simply exchanging a second lever 21 or a corresponding securing element 2 with a correspondingly desired selector angle 23, the firing selection position can be adjusted relatively easily by the shooter. Moreover, it is therefore relatively easy to retrofit the safety selector 1 which can be operated from one side to a safety selector 1 which can be operated from both sides.

In addition, it can be advantageous if the user is given the option of providing two different cams, i.e. a primary cam 241 and a secondary cam 141, on a safety selector 1. This situation is shown, for example, in FIG. 5B, in which a secondary cam 141 is formed on the bearing portion 14. This is also shown schematically in FIGS. 7, 8 and 10. The designation and design of the mounting groove 242 and the selector grooves 243 remains unchanged, since it is left to a person skilled in the art to optimize their number, size, shape and arrangement with knowledge of the present disclosure and in consideration of the respective operational requirements. It should be noted, however, that the design of the safety shaft 13, more precisely of the selector portion 15, is related to the design of the primary cam 241 and/or secondary cam 141.

This is evident from the exemplary sectional views in FIGS. 6A to 6B, which show, purely schematically, different situations on the plane C-C' in FIG. 5A. FIGS. 6A to 6C each show selector portions 15 which have an acentrically located bore 17, a safety surface 153 and at least one primary selector surface 151. In a generally known manner, the safety surface 153 represents the lateral surface along the circumference of the selector portion 15, or at least a part thereof, and is used to block the trigger in the "safe position".

In the position indicated in FIG. 5, the primary selector surface 151 is set to active, i.e. a ready-to-fire state of the rifle is set, since the selector surfaces 151 in FIGS. 6A to 6C represent a planar recess relative to the safety surface 153, as a result of which the trigger can be deflected again ("firing position").

FIG. 6A shows a section through a selector portion 15, which represents the most common variant of a safety shaft 13 which only allows a "safe position" and a "firing position". The corresponding primary cam 241 must therefore have a selector angle 23 of approximately 90° in order to interact correctly with this type of selector portion 15, which is sufficiently known to a person skilled in the art without further explanation.

A somewhat different situation can be achieved with a selector portion 15 as shown in FIG. 6B. When the primary cam 241 on the securing element 2 is used, similarly to the situation in FIG. 6A, there is only one possibility for setting the firing position. In a preferred embodiment, the selector portion 15 has an additional, secondary selector surface 152. By means of forming the second selector surface 152 on the selector portion 15, it is possible, in cooperation with the teachings of the present disclosure, to adapt the selector angle 23 of the primary cam 241. For example, by exchanging the securing element 2 or the second lever 21, a second selector angle 23*a* can be obtained which is not equal to the original selector angle 23. The selector angle 23 in the "standard configuration" is usually 90°, whereby it can be advantageous to provide a second selector angle 23*a* smaller than 90°, preferably in the angular range of 40° to 80°, for operating the rifle in order to achieve, for example during competitions or also in tactical deployment, a shorter actuating path when adjusting the safety selector 1.

In a further preferred embodiment (FIGS. 5-7), the bearing portion 14 of the first lever 11 has a secondary cam 141 in the circumferential direction 53, which secondary cam 141 comprises a mounting groove 242 directed toward the weapon midplane. It is in this case advantageous that the selector portion 15 has an additional, secondary selector surface 152, as can be seen by way of example in FIG. 6C. Such a configuration now offers the possibility of setting the selector angle 23 without having to replace or exchange the second lever 21. If the primary cam 241 is designed with a selector angle 23 of 90° and the secondary cam 141 is designed with a selector angle 23*a* of less than 90°, then by retrofitting the first lever 11 onto the right-hand weapon side and coupling the second lever 21 to the left-hand weapon side, a relatively simple adaptation of the selector angle 23 can be made. In an advantageous embodiment, the secondary cam 141 is thus shorter in the circumferential direction 53 than the primary cam 241, preferably extending over a second selector angle 23*a* of 40° to 80°, particularly preferably of approximately 55°.

The advantage, according to the present disclosure, of this embodiment, namely to allow adjustment of the actuating path or the selector angle 23 by simply reversing the insertion direction of the safety selector 1, is made possible by the positioning protrusion 18 of the first lever 11. Upon insertion from the "right-hand side", this positioning protrusion 18 serves to deflect the spring-loaded selector pin in the lower receiver 4, thus making the insertion possible in the first place without removing the selector pin. When the opposite left side of the lower receiver 4 is reached, the bearing portion 14 reaches the predetermined position on the right-hand side of the lower receiver 4 without blocking, since the secondary cam 141 also has a mounting groove 242 open to the opposite side of the weapon and thus allows the selector pin to enter the secondary cam 141 unhindered. This situation can easily be understood from FIGS. 8 to 10.

In one particular embodiment, formed on the connecting element 16 is a closing protrusion 19 which primarily serves to close the mounting groove 242 of the primary cam 241 in the installed situation in the direction of the weapon midplane. In this way, additional protection is provided against the ingress of any dust and/or other foreign bodies. This closing protrusion 19 can further fulfill a function as a positioning aid during insertion and also acts as an additional support in the radial direction when installed. In this way, the transmission of force or torque when the safety selector 1 is actuated can be improved, in particular when a second lever 21 is used.

Further positioning aids can also be provided, as can be seen, for example, in FIGS. 5A and 5B with a further step on the positioning protrusion 18. If a corresponding counterpart is provided on the securing element 2, as can be seen quite clearly from the perspective in FIG. 2, such a positioning aid can certainly also contribute to transferring the forces or the torque when the safety selector 1 is actuated. Such positioning aid pairs can be designed as protrusions and corresponding recesses, and also, for example, as notches with beveled surfaces. By reason of the brevity of the present description and the clarity of the representation, reference symbols therefor are dispensed with.

It is clear to a person skilled in the art that the embodiments disclosed were selected as schematic and/or exemplary representations and it is easily possible for a skilled person to transfer the relationships provided by the present disclosure to embodiments that have not been explicitly shown, and therefore these implicitly disclosed embodiments can be implicitly understood both in the description of the figures and in the claims.

LIST OF REFERENCE NUMERALS

| | | | |
|---|---|---|---|
| 1 | Safety selector | 24 | Bearing protrusion |
| 11 | First lever | 241 | Primary cam |
| 12 | First handle | 242 | Mounting groove |
| 13 | Safety shaft | 243 | Selector groove |
| 14 | Bearing portion | 25 | Coupling recess |
| 141 | Secondary cam | 26 | Catch surface |
| 15 | Selector portion | | |
| 151 | Primary selector surface | 3 | Connecting assembly |
| 152 | Secondary selector surface | 31 | Connecting element |
| 153 | Safety surface | 32 | First end |
| 16 | Connecting portion | 33 | Second end |
| 17 | Bore | 34 | Flattened portion |
| 18 | Positioning protrusion | 35 | Bolt protrusion |
| 19 | Closing protrusion | 36 | Spring |
| | | 37 | Spring lock |
| 2 | Securing element | 4 | Lower receiver |
| 21 | Second lever | 51 | Bore direction/longitudinal direction |
| 22 | Second handle | 52 | Radial direction |
| 23 | Selector angle | 53 | Circumferential direction |

The invention claimed is:

1. A safety selector for a firearm, comprising:

a first lever, a securing element, and a connecting assembly;

wherein:

the first lever includes a first handle and an integrally-formed safety shaft, and is configured for a spring-biased coupling to the securing element; wherein:

the safety shaft is configured to be received in a lower receiver of the firearm and to be rotatable into at least one firing selection position, and includes a first, substantially cylindrical bearing portion joined to the first handle in a direction toward an opposite weapon side, a selector portion formed adjacent to the bearing portion and having at least one primary selector surface, and a connecting portion adjacent to the selector portion;

the first handle is configured to be outside the lower receiver for actuation of the safety selector when the safety shaft is received in the lower receiver;

the securing element includes a substantially cylindrical bearing protrusion for mounting in the lower receiver, the bearing protrusion having in a circumferential direction a primary cam configured to interact with a selector pin disposed in the lower receiver, where the primary cam also defines a mounting groove that is directed toward a weapon midplane;

the connecting assembly includes a connecting element, a spring, and a spring lock; the connecting element being configured at a first end for coupling to the spring lock and configured at its opposite, second end for coupling to the securing element;

wherein:

the first lever has, on the connecting portion of the safety shaft, a positioning protrusion projecting in a direction toward the opposite weapon side, and, in a longitudinal direction, a bore of complementary shape for receiving the connecting assembly; and the bearing protrusion defines a coupling recess that opens outwardly in a radial direction and in the longitudinal direction and is configured to couple to the second end of the connecting element and the positioning protrusion.

2. The safety selector according to claim 1, wherein the second end of the connecting element has at least one bolt protrusion projecting normally to the longitudinal direction, the bolt protrusion being configured to couple to the coupling recess of the securing element.

3. The safety selector according to claim 1, wherein the second end of the connecting element and/or the spring lock has/have a non-circular cross-sectional shape.

4. The safety selector according to claim 1, wherein the second end of the connecting element and/or the spring lock has/have an elliptical, oval, or polygonal cross-sectional shape.

5. The safety selector according to claim 1, wherein the second end of the connecting element and/or the spring lock has/have a rectangular cross-sectional shape.

6. The safety selector according to claim 1, wherein the coupling recess of the securing element includes a catch surface that is complementary in shape to the second end of the connecting element and/or to the positioning protrusion.

7. The safety selector according to claim 6, wherein the second end of the connecting element includes a flattened portion that is complementary in shape to the catch surface.

8. The safety selector according to claim 1, wherein the first end of the connecting element and the spring lock are coupled by a threaded connection.

9. The safety selector according to claim 1, wherein the selector portion of the safety shaft includes an additional, secondary selector surface.

10. The safety selector according to claim 1, wherein the securing element further comprises a second lever formed on the securing element, the second lever including a second handle configured to be located outside the lower receiver on the opposite weapon side for ambidextrous operation of the safety selector.

11. The safety selector according to claim 9, further comprising a secondary cam defining a mounting groove directed toward the weapon midplane, wherein the secondary cam is formed on the bearing portion of the first lever in the circumferential direction.

12. The safety selector according to claim 11, wherein the secondary cam is shorter in the circumferential direction than the primary cam.

13. The safety selector according to claim 12, wherein the secondary cam extends over a second selector angle of 40° to 80°.

14. The safety selector according to claim 12, wherein the secondary cam extends over a second selector angle of approximately 55°.

15. The safety selector according to claim 1, further comprising a closing protrusion is formed on the connecting portion that is configured to cover the mounting groove when the safety selector is in an installed state.

16. The safety selector according to claim 1, wherein the bore is configured as a stepped bore.

17. The safety selector according to claim 1, further comprising at least one interacting positioning aid pair formed on the connecting portion and the securing element.

* * * * *